United States Patent [19]

Dreger

[11] 3,972,083

[45] Aug. 3, 1976

[54] PUNCH FOR MAKING RECESSED SCREW

[75] Inventor: Geoffrey Dreger, Etobicoke, Canada

[73] Assignee: P.L. Robertson Manufacturing Co. Ltd., Canada

[22] Filed: Jan. 13, 1975

[21] Appl. No.: 540,630

Related U.S. Application Data

[60] Division of Ser. No. 189,477, Oct. 31, 1971, abandoned, which is a continuation-in-part of Ser. No. 835,431, June 23, 1969, Pat. No. 3,604,305.

[52] U.S. Cl. ..... 10/7; 10/26

[51] Int. Cl.[2] ..... B23G 9/00; B21K 1/46

[58] Field of Search ..... 10/5, 7, 24, 26; 85/9, 85/32, 45

[56] References Cited

UNITED STATES PATENTS

| | | | |
|---|---|---|---|
| 1,003,657 | 9/1911 | Robertson | 10/26 |
| 2,914,984 | 12/1959 | Ansingh | 85/45 |
| 2,977,838 | 4/1961 | Oestereicher | 10/7 |

FOREIGN PATENTS OR APPLICATIONS

| | | | |
|---|---|---|---|
| 282,483 | 8/1952 | Switzerland | 85/45 |
| 250,449 | 6/1948 | Switzerland | 85/45 |

*Primary Examiner*—Lowell A. Larson
*Assistant Examiner*—E. M. Combs
*Attorney, Agent, or Firm*—Joel E. Siegel

[57] ABSTRACT

A tapered punch for producing a recessed screw, the punch having an axially extending recess forming portion of symmetrical cross section and presenting in cross section 8 symmetrically disposed corners in 45° spaced relation with any 4 alternate corners lying on the corners of one square and the remaining 4 alternate corners lying on the corners of another square in 45° angular relation to the first mentioned square, and a method for cold forming the recess by evenly spreading flow of the metal.

1 Claim, 9 Drawing Figures

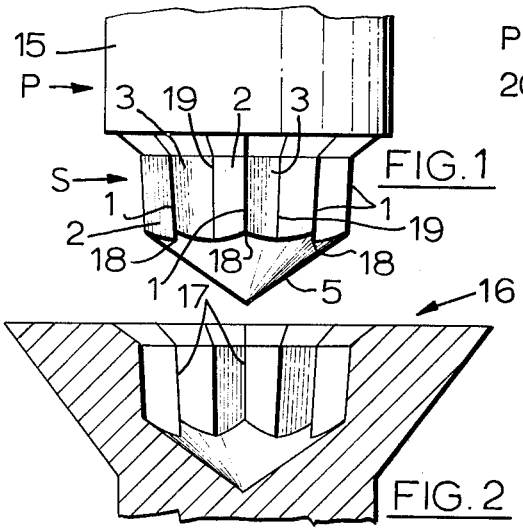
FIG. 1
FIG. 2
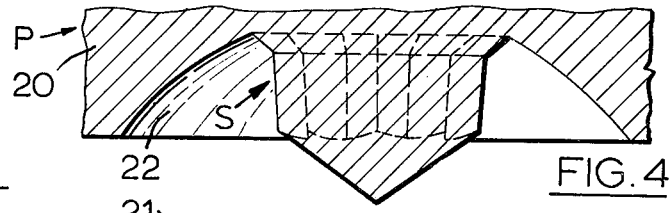
FIG. 4
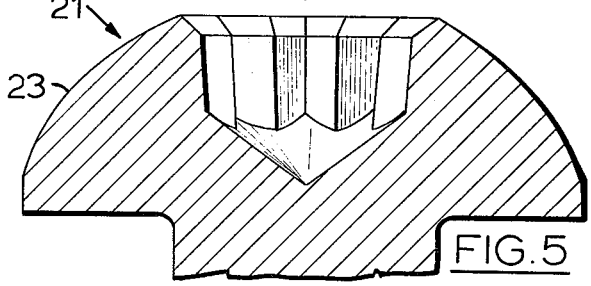
FIG. 5
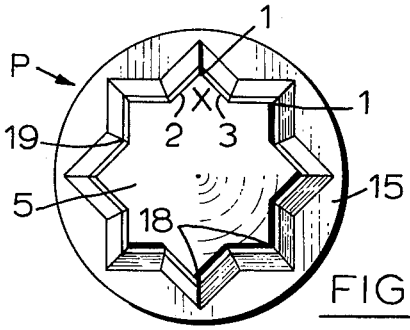
FIG. 3
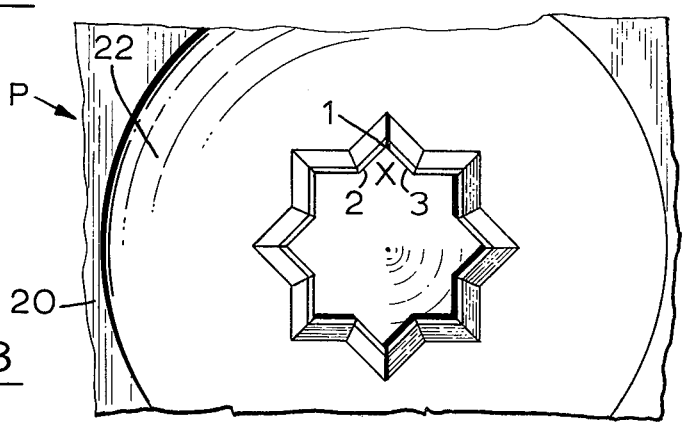
FIG. 6
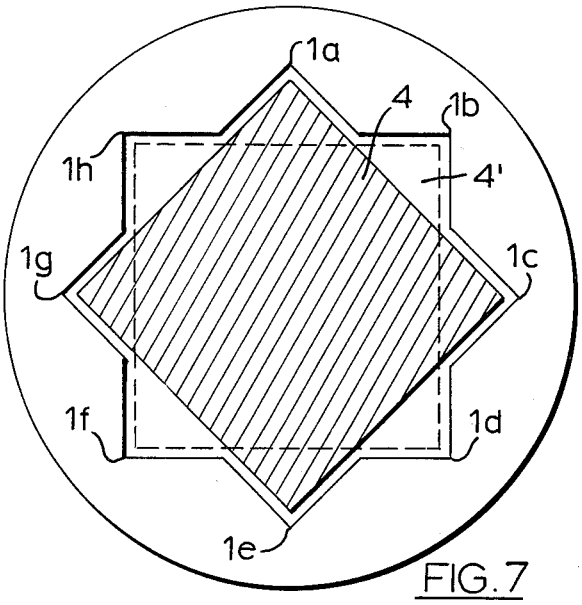
FIG. 7
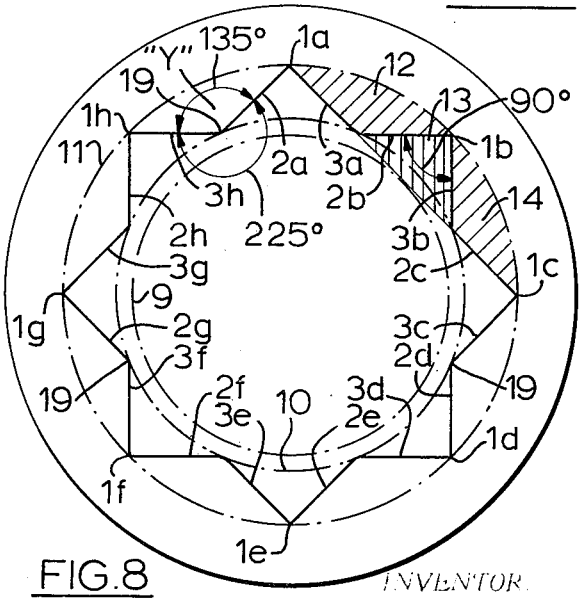
FIG. 8
INVENTOR
GEOFFREY DREGER
BY Douglas L. Johnson INVENTOR.
GEOFFREY DREGER
BY Douglas A. Johnson

PUNCH FOR MAKING RECESSED SCREW

This is a division of application Ser. No. 189,477, filed Oct. 31, 1971, now abandoned which is a continuation-in-part of application Ser. No. 835,431, filed June 23, 1969, now U.S. Pat. No. 3,604,305.

FIELD OF INVENTION

This invention relates to improvements in tools for forming recessed screws and similar fasteners and more particularly to an improved punch for producing a fastener recess adapted to receive a driving bit of square cross section or presenting a square configuration.

RELATED INVENTIONS

Related inventions comprising the recessed screws produced by the improved punch of this invention as disclosed in U.S. Pat. No. 3,604,305 and a driver bit for driving such screws.

BACKGROUND OF THE INVENTION

Square punches for making recessed fasteners have many defects. One particular problem is in making the punch itself, which, because of its square configuration, is not easily formed. Another problem is to punch a square recess into a screw head without distorting the head out of true circular form. Still another problem is that the amount of metal working required in puching a square recess by a single blow into a circular blank head at room temperature is very considerable and is liable to create non-uniform stresses in the head. This is particularly true where the screw is to be formed of stainless steel or other hard to work with metals. At the same time the number of critical wear absorbing surfaces on square punches are limited, such wear occurring particularly at the four bottom corners of the punch; with the result that punch wear is quite considerable.

Also in the punching of a square recess into a round blank there is a tendency of the metal in the screw head to fall away from the punch if the side walls of the socket are made parallel to the screw axis and accordingly the socket walls must be inclined to such axis. Because of this side wall taper it has been found that any appreciable wear on the punch will provide a recess formation that will have a different bottom dimension than the recess originally produced by the punch and the appropriate driver designed for the original recess will not seat fully home and will not be in optimum fit with the recess. As a result punch life is a significant factor in limiting production and manufacturing costs, and it would be of very considerable importance to providing a "square" socket formation while extending punch life.

Prior art punches having flat walls at right angles to each other are easily broken by side deflection forces which occur when the punch and blank are not accurately aligned. Further, metal does flow evenly over the flat walls of square punches, and this results in numerous defects in the end product.

SUMMARY OF THE INVENTION

It is an object of this invention to provide a punch which can be readily and economically manufactured and which will enable the production of a fastener recess adapted to receive in accurate driving fit a tool presenting a square configuration while at the same time providing a substantially increased punch life over present square punches to thereby materially reduce production costs.

Another object is to provide a punch which will produce a screw recess in a screw head while retaining the accurate circular configuration of the screw head and essentially eliminating any crystallized or highly stressed areas in the head.

Another object is to provide a punch which will produce a recess which is of esthetic appearance yet which will receive a square cross section tool in accurate driving fit. Moreover, in this connection the invention provides for an easier entrance of the driving tool without loss of accuracy of ultimate fit or any significant loss of ability to effect torque transfer.

Another object is to provide a punch having walls reinforced so as to resist breaking caused by side deflection forces.

Another object is to provide an improved method of punching a recess in the head of a fastener that does not require cold flow of metal in a vertical direction over relatively broad flat punch surfaces.

According to the present invention the improved punch is of symmetrical tapered configuration having in cross section eight peripheral outer corners or edges disposed in 45° angularly spaced relation around a central axis, such that any set of four alternate or 90° relatively spaced corners or edges fall on the corners of a first square and the remaining set of four alternate or 90° relatively spaced corners or edges fall on the corners of a second square in 45° angular relation to the first square whereby the punch is adapted to produce an eight pointed or cornered recess capable of receiving a square driving tool in two 45° angularly spaces positions. The corners of each square define tapered wedges centered on the walls of the alternate square. The tapered wedges reinforce the side walls of the alternate square against breakage caused by side deflection forces, and the wedges also evenly spread flow of metal when the recess is formed by delivery of a single punch blow at room temperature.

Preferably according to the invention such eight peripheral outer corners or edges are each defined by a pair of right angularly disposed wall portions meeting each other at an angle of 90° to define a right angled corner and meeting with the wall portions of adjoining corners to define a part of an angle of 135°.

Also according to the preferred embodiments of the invention the wall portions defining such eight right angled corners are arranged to taper slightly inwardly so as to meet at a point on the center axis of the punch, and the bottom wall of the punch is of generally conical form.

BRIEF DESCRIPTION OF THE DRAWINGS

FIG. 1 is a broken away elevational view of a punch according to the invention for forming a socket in a flat head screw.

FIG. 2 is a mid vertical sectional view of the head of a screw in a socket formation which has been punched by the punch of FIG. 1.

FIG. 3 is an underside plan view of the punch of FIG. 1.

FIG. 4 is a view similar to FIG. 1 but showing a modified form of punch embodying the invention for forming a socket and at the same time providing a heading operation to produce a round headed screw.

FIG. 5 is a mid vertical sectional view of the head of a screw produced by the punch of FIG. 4.

FIG. 6 is an underside plan view of the punch of FIG. 4.

FIG. 7 is an enlarged schematic view showing the outline in underside plan of a punch according to the invention and illustration by means of cross hatching within a solid square outline one effective square recess area the punch will produce in the screw head and in dotted outline the other effective square recess area the punch will produce in 45° angular displacement from the first area.

FIG. 8 is an enlarged part underside plan part diagrammatic view comparing the metal a punch according to the invention will displace in the production of a screw recess and the metal a punch adapted to produce a square recess will displace.

DETAILED DESCRIPTION OF THE INVENTION

Figure 9:
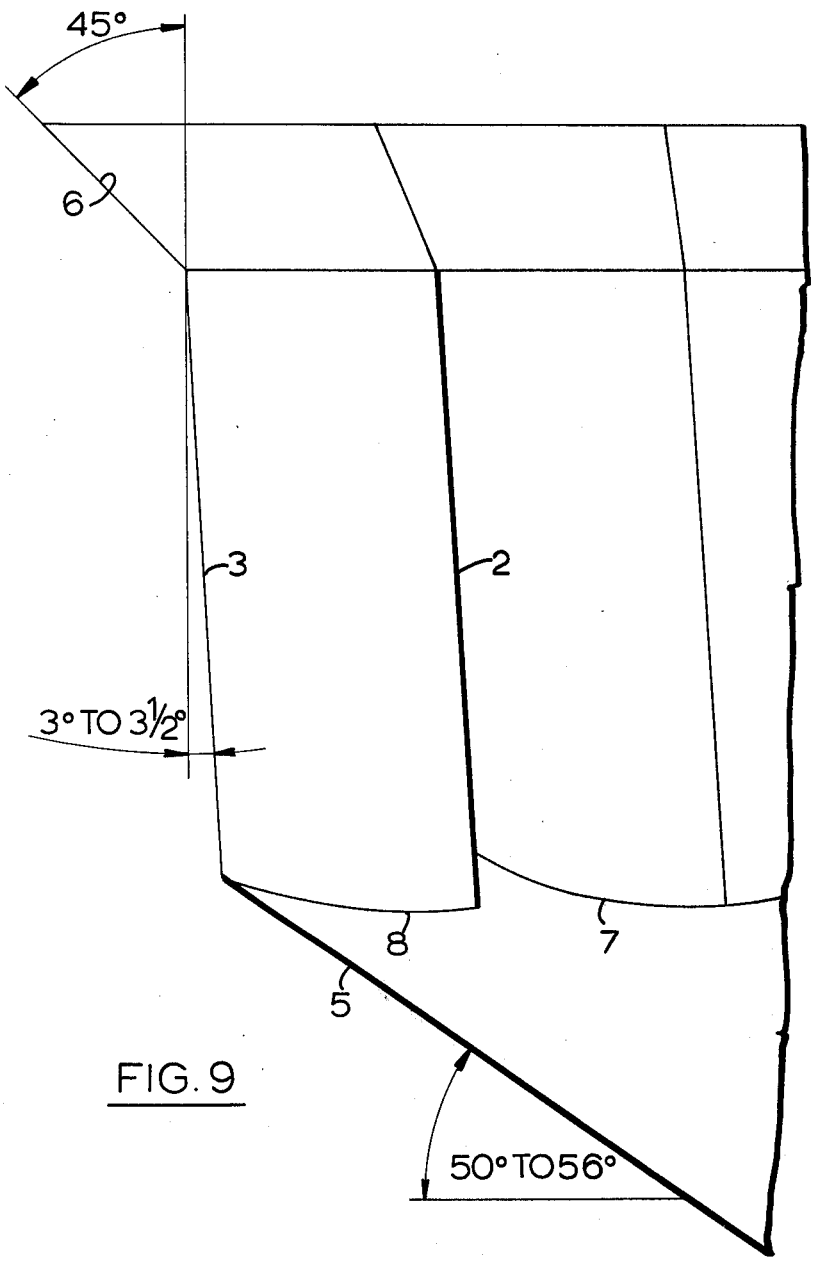
FIG. 9 is an enlarged part vertical sectional view of a punch according to the invention.

Referring first to FIG. 3 it will be seen that the punch of the present invention generally designated at P is formed to present eight symmetrically disposed corners or edges 1 each defined by right angularly disposed adjoining wall portions 2 and 2 which define a corner angle "*x*" of 90° at each of the corners. With reference to FIGS. 7 and 8 the edges or corners 1 starting from the top and moving clockwise are designated 1*a*, 1*b*, 1*c*, 1*d*, 1*e*, 1*f*, 1*g*, and 1*h* and the defining wall portions are designated 2*a* 3*a*, 2*b* 3*b*, 2*c* 3*c*, 2*d* 3*d*, 2*f* 3*f*, 2*g* 3*g*, 2*h* 3*h*. It will be seen that the corners 1*a*, 1*c*, 1*e*, and 1*g* in conjunction with the wall portions 2*a* 3*a*, 2*c* 3*c*, 2*e* 3*e*, and 2*g* 3*g* define one square outline 4 shown in solid line and cross hatched. The alterntative sequence of corners and wall portions 1*b*, 1*d*, 1*f*, and 1*h* and 2*b* 3*b*, 2*d* 3*d*, 2*f* 3*f*, and 2*h* 3*h* also define a square outline 4' shown in dotted line in FIG. 7 in a 45° angular relation to the square outline 4. Adjoining wall portions such as 2*a* and 3*h* meet to define an included angle "*y*" *of* 135° and an internal angle of 225°.

As seen in FIG. 9 the wall portions 2 and 3, all of which are identical in shape and area preferable deviate slightly from the vertical and incline inwardly at an angle of from 3 to 3½° towards the bottom wall 5 of the punch which preferably is of conical form having an angle from 50° to 56° to the horizontal. At the top the punch is also preferably bevelled as at 6 at an angle of 45° to provide a chamfered recess entrance. The juncture of the conical bottom wall 5 and the side walls 2 and 3 are defined by arcutate juncture lines 7 and 8.

As will be seen from FIG. 8, the eight cornered punch of the present invention will provide a recess having an increased area of entrance as compared to the recess produced by prior art square recess producing punches. In this connection the inner circle 9 represents the area which would be cleared by a square cross section punch and hence the area available for entrance of a square driver bit into such a square recess. The second inner circle 10 represents the area which in fact is cleared by the present punch and hence the area available for entrance of a square cross section bit into a recess produced by a punch of the present invention. The area between the two circles 9 and 10 represents increased area for entrance, i.e. the increased ease of driver bit entrance produced by the punch of the present invention over a square recess producing punch.

In forming a recess in a screw head the distortion to which the head is subjected has been found to vary almost directly to the degree that the recess deviates from a circle. Thus, as seen with reference to FIG. 8, a square punch involves the displacement out of circular form of four times the mass of metal lying between the inner circle 9 and the outer circle 11 between say corner 1*a* and corner 1*c* and represented by the shaded areas, 12, 13, 14. In the case of the punch of the present invention the amount of metal displaced out of circular form is represented only by four times the shaded areas 12 and 14 and all of this mass lies between the second inner circle 10 and the outer circle 11. As a result, it has been found that the eight cornered punch can form a recess in a screw head without distorting the round configuration of the head. This ability to maintain a precisely circular head configuration has not heretofore been possible with square punches.

The precisely circular form is achieved by the ability of the punch to uniformly stress the metal of the head so that essentially no crystallized or highly stressed metal areas which are subject to fracture occur in the head. Further this ability to maintain perfectly round screw heads while forming the recess coupled with the esthetic appearance of the eight point recess enables the punch to produce a screw of highly desirable appearance for use on exposed surfaces.

The punches P of the present invention while having recess forming shank portions S of corresponding cross sections may be adapted for use with different types of screws. For example, the punch P of FIG. 1 has the shank portion S projecting from the end of the punch body 15 and is used to produce a flat head screw 16 shown in FIG. 2. One of the critical points of wear in a punch occurs at a corner such as the corners 1 which form the points of corners 17 of the screw socket. This wear is particularly concentrated at the juncture points 18 of the edges 1 with the bottom wall formation 5. In the case of the square cross section punch for producing a square recess, the impact blow of the punch is absorbed at only four corners and when these corners wear, the recess will not be sufficiently accurate to allow the driving bit to seat firmly and properly in the recess. This problem is compounded when the side walls of the punch and hence recess are tapered because of the mismatch of the driver bit taper with the recess taper if the bit cannot seat fully home.

In the case of the punch of the present invention, eight corner juncture impact absorbing points 18 are provided with the result that the wear per corner is substantially reduced. This fact coupled with the ease of forming the metal of the screw head around the more clearly circular shape of the punch in comparison with the flat sided prior art square punch provides a substantially increased punch life so that each punch can produce a substantially greater number of recessed screws before replacement. Moreover the more nearly circular shape of the punch greatly facilitates the ease and cost of making the punch itself so that the initial punch cost is less than the present square punches.

Desite the provision of the eight corners 1 and the eight junctures 19 intermediate of the corners 1 on the punch, there are not corners or junctures less than 90° and therefore no thin punch sections which would tend to fracture, and there are correspondingly no thin recess sections which would tend to ream out under high torque. Furthermore, this punch is not easily broken by the side deflection forces from off center punching blows because the wall portions, in effect, reinforce each other. This advantage can be better understood by referring to FIG. 7 where the cross hatched square 4 can be regarded as a cross section of conventional prior art square punch; note that the sides of square 4 are relatively wide and flat. However, the corners 1*b*, 1*d*, 1*f*, and 1*h* of the dotted square 4′ are at the center of the sides of square 4. Thus, the corners of square 4′ act as reinforcing ribs for square 4, and vice versa, thereby preventing fracture of the punch by side deflection forces.

FIG. 4 illustrates a punch having a modified form of body 20 used to produce the screw 21. In this case the shank S is set in a recess 22 formed in the end of the body 20 and this recess 22 is adapted to shape the rounded head 23 of the screw 21 at the same time that the recess forming shank S forms the screw recess.

While the preferred punch has been illustrated, variations may for example be made in the punch taper. For instance because the displacement of metal out of circular form in producing screws with punches of the present invention is less than in the case of simple square cross section punches, the fall away of metal from this punch during forming is less and therefore more nearly vertical recess side walls forming an accurate reproduction of the punch can be obtained with the present punch than with simple square punches.

Also, square punches produce a larger number of fasteners with defective recesses because they require that the metal being deformed flow across the entire relatively broad surface of each of their four sides. In the present eight sided punch, the corners 1 of each square 4 and 4′ function as tapered wedges which uniformly spread the flow of metal and ease the entry of the punch into the blank being deformed. FIG. 7 reveals that corners 1*b*, 1*d*, 1*f*, and 1*h* of dotted square 4′ are centered on the sides of cross hatched square 4. As seen in FIG. 3, such corners define inwardly tapered wedges, the projections of which would terminate on the center axis of the punch. Such wedges spread the flowing metal laterally and therefore cause it to flow more evenly over the entire surface of any side of either square 4 or 4′.

The present punch also provides a larger number of driver bit engaging wall surfaces in the resulting recess than is available from a simple square punch, thereby enabling the taper of the recess wall to be increased without loss of driver bit cling. An eight cornered driver bit having a cross section corresponding to this punch is disclosed in co-pending application Ser. No. 835,533, filed June 23, 1969.

Although the forms of the invention shown and described herein constitute preferred embodiments, it is not intended to illustrate herein all equivalent forms and ramifications thereof. Also, the words used are words of description rather than of limitation, and various changes may be made without departing from the spirit or scope of the invention.

I claim:

1. A punch for producing a tool engaging socket in the head of a threaded fastener by a single blow delivered at room temperature comprising an axially extending socket forming portion centered on and symmetrical relative to the longitudinal axis of said punch and presenting in cross section eight symmetrically disposed corners, each corner being defined by a pair of identical wall portions which intersect at a right angle, any series of four alternate corners and their defining wall portions outlining a square, the remaining series of four alternate corners and their defining wall portions outlining a second square in 45° angular relation to said first-mentioned square, each wall portion defining a part of an included angle of 135° with a wall portion defining a part of the next adjacent corner along an intersection equally spaced from such corners to provide a total of sixteen identical wall portions, each of said wall portions being inclined toward said axis of said fastener so that said punch tapers towards its terminal end, said intersections defined by said included angles being inclined to said axis of said fastener at an angle greater than the angle of inclination of said sidewall portions, and the lines of intersection at said corners being inclined to said axis of said fastener at an angle greater than the angle of inclination defined by said included angles, each corner of each of said series of four alternate corners providing an additional downwardly tapered wedge of material symmetrically centered on a side of said square outlined by the other of said series of four alternate corners, each of said downwardly tapered wedges of material extending in a direction away from the center of said punch beyond the side upon which it is centered so as to reinforce such side against breaking caused by side deflection forces, and said terminal end being generally conical.

* * * * *

UNITED STATES PATENT AND TRADEMARK OFFICE

CERTIFICATE OF CORRECTION

PATENT NO. : 3,972,083

DATED : August 3, 1976

INVENTOR(S) : Goeffrey Dreger

It is certified that error appears in the above-identified patent and that said Letters Patent are hereby corrected as shown below:

In column 2, line 35 delete "spaces" and insert --spaced--.

In column 3, line 44 delete "preferable" and insert --preferably--.

In column 4, line 53 delete "clearly" and insert --nearly--.

In column 4, line 61 delete "Desite" and insert -- Despite --.

Signed and Sealed this

Fifth Day of October 1976

[SEAL]

*Attest:*

RUTH C. MASON
*Attesting Officer*

C. MARSHALL DANN
*Commissioner of Patents and Trademarks*